United States Patent [19]

Haines

[11] 4,423,869

[45] Jan. 3, 1984

[54] GAMES RACKET FRAME

[75] Inventor: Robert C. Haines, Huddersfield, England

[73] Assignee: Dunlop Limited, London, England

[21] Appl. No.: 325,197

[22] Filed: Nov. 27, 1981

[30] Foreign Application Priority Data

Dec. 3, 1980 [GB] United Kingdom ..... 8038745

[51] Int. Cl.[3] ..... A63B 49/10; A63B 49/12

[52] U.S. Cl. ..... 273/73 C; 273/73 K; 273/DIG. 7; 273/DIG. 23

[58] Field of Search ..... 273/73 C, 73 D, 73 F, 273/73 K, 73 H, 73 R, DIG. 7; 264/273

[56] References Cited

U.S. PATENT DOCUMENTS

| | | | |
|---|---|---|---|
| 1,678,637 | 7/1928 | Drevitson | 273/173 |
| 3,352,566 | 11/1967 | Kennedy | 273/73 K X |
| 3,986,716 | 10/1976 | Taussig et al. | 273/73 C |
| 4,119,313 | 10/1978 | Popplewell | 273/73 K |
| 4,194,738 | 3/1980 | Inoue et al. | 273/73 C |
| 4,203,596 | 5/1980 | Nagamoto | 273/73 J |

FOREIGN PATENT DOCUMENTS

| | | |
|---|---|---|
| 2243001 | 4/1975 | France . |
| 1295704 | 11/1972 | United Kingdom . |

*Primary Examiner*—Richard C. Pinkham
*Assistant Examiner*—Matthew Schneider
*Attorney, Agent, or Firm*—Stevens, Davis, Miller & Mosher

[57] ABSTRACT

A frame for a games racket comprises a hollow plastics moulding which is at least partially reinforced by means of a rigid member integrally moulded therewith. The rigid member can consist of a metal plate having perforations which, when the plate and the plastics material are moulded together, are penetrated by the plastics material, which sets therein to lock the plate to the moulding.

The plate may, for example, extend over an area corresponding to the crown portion of the frame so as to provide for localized reinforcement, particularly, in the event of impact (e.g. when the racket is dropped on to a hard surface).

7 Claims, 2 Drawing Figures

GAMES RACKET FRAME

This invention relates to frames for games rackets and in particular to frames made in the form of a hollow moulding of plastics materials.

Any games racket may fracture if dealt a sufficiently severe blow, particularly if the racket is dropped or thrown on to a hard surface from a height of several feet.

Our co-pending U.K. Application No. 80/26222 discloses a means whereby a racket frame is constrained to hold together in the event of a fracture, even if the fracture is one which in a conventional racket would result in one portion of the frame completely separating from the ramainder. The said co-pending Application achieves this by providing a cord passing around the inside of the hollow frame, the ends of the cord being anchored to the frame so that the cord is held in tension.

We have found that racket frames are liable to breakages in the region of the crown of the racket head when subjected to a sufficiently severe impact. For example, if the racket is dropped on to a hard surface in such a manner that the racket shaft is vertical at the moment of impact, then the full force of that impact is borne by the crown of the racket head.

We have found that this problem can be alleviated by providing for localised increase of the strength and stiffness of the racket head in the region of the crown.

We have also found that the aforesaid increase in strength and stiffness may conveniently be achieved by providing rigid reinforcing means in the racket frame in the region of the crown.

Accordingly, the present invention provides a frame for a games racket, the frame comprising a hollow moulding of a plastics material and being at least partially reinforced by means of a rigid member, the rigid member being integrally moulded with the plastics material.

Preferably, the rigid member is completely enclosed within the plastics material.

In one preferred embodiment, the rigid member extends over an area substantially corresponding to the crown portion of the racket frame.

In a second preferred embodiment, the rigid member has a plurality of perforations therein, whereby, when the plastics material and the rigid member are moulded together, the plastics material penetrates the perforations during moulding and sets therein to lock the rigid member to the frame during the moulding operation.

The most suitable material for the said rigid member is a metal, e.g. aluminium, or an alloy, e.g. mild steel, stainless steel or brass.

Perforated metal plates are conventionally produced by means of a die-pressing operation and this results in the perforations being of non-uniform diameter relative to the major parallel faces of the plate, i.e. opposite diameters of each perforation are different from each other.

We have found that this non-uniformity can be used to enhance the locking of the plate with the plastics material of the frame.

The locking effect obtained between the perforated plate and the frame enables the strength and stiffness of the plate to be effectively added to that of the material of the frame.

Preferably, the plate may be so shaped that when it is in position in the frame it increases local stiffness and so reduces distortion of the head of the frame under impact conditions. This may be effected by bending the plate into a generally U-shaped channel section and placing the plate in the mould in such a way that, in the finished frame, the base of the U is adjacent the strung area of the head of the frame.

The weight and dimensions of the metal plate are selected so that there is no undue "weight-penalty" imposed on the finished frame.

Appropriately-sized holes, to correspond to the stringing holes in the finished frame, are provided in the perforated plate. Where the frame is of the type having its stringing holes defined by pillars integrally formed in the frame, holes are provided in the plate to accommodate those pillars.

The plastics material used to make the hollow moulding may itself be reinforced. Preferably, the moulding may be of a reinforced thermoplastics material such as Nylon 66 reinforced with carbon fibres or glass fibres or a combination thereof. For example, the moulding may comprise (a) Nylon 66 with 30% carbon fibres by weight *or*
(b) Nylon 66 with 40% glass fibres by weight *or*
(c) Any combination of (a) and (b), e.g. 20% carbon fibres and 20% glass fibres.

Racket frames made according to the present invention are suitable for manufacture by the means described in our co-pending U.K. application Nos. 2015886 and 2056864.

The present invention will be illustrated, merely by way of example, in the following description and with reference to the accompanying drawings.

Figure 1:
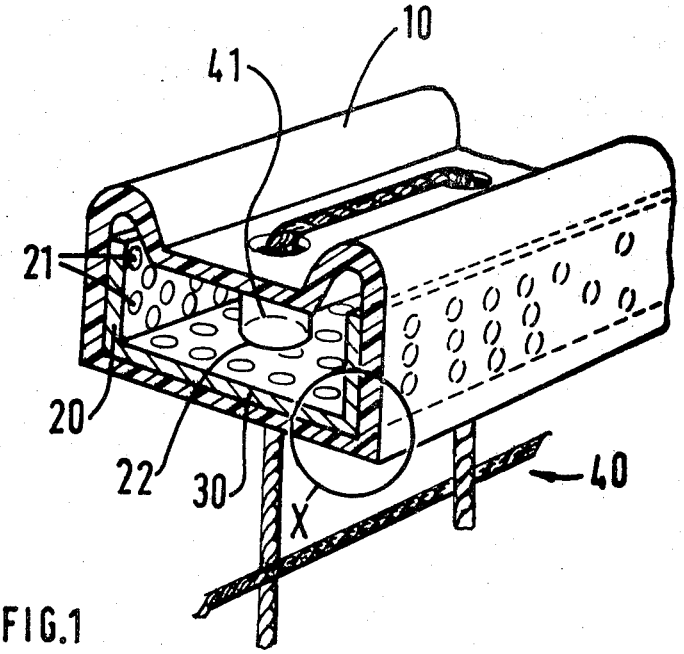
FIG. 1 is a view, partly in perspective and partly in section, of a portion of a racket frame according to the present invention.

A frame for a games racket according to the present invention comprises a hollow plastics moulding 10 and a rigid member. The rigid member consists of a metal plate 20 and is made from a sheet of mild steel 0.036 inches (0.914 mm) thick. The plate 20 is provided with a plurality of perforations 21, each perforation having an average diameter of 0.062 inches (1.575 mm). The weight of the plate is 4 g.

The plate 20 is bent to form a U-shaped channel and is placed in a mould with the plastics material forming the hollow frame so that, during the moulding process, the plastics material flows into the perforations 21 and sets therein to form projections 11. Thus, the plate 20 is locked into the plastics material (as shown schematically in FIG. 2).

The plate 20 is, in a preferred embodiment of the present invention, fixed in position on the inner surface of the hollow frame 10 so that the base 30 of the U-shaped channel is adjacent the strung area 40 of the racket head.

The plate 20 is further provided with holes to coincide with stringing holes in the racket frame. In FIG. 1, one such hole 22 is shown engaging a stringing pillar 41 (known per se).

Figure 2:
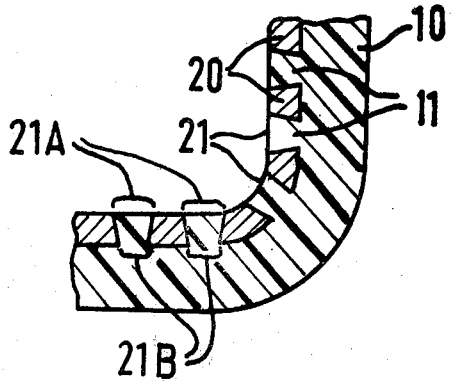
FIG. 2 is an enlarged view of the portion encompassed by a circle and marked "X" in FIG. 1.

As shown in FIG. 2, the perforations 21 are of non-uniform diameter, i.e. the diameters of the holes on the inner surface of the plate (21A) differ in size from those on the outer surface (21B). This enhances the locking action between the plate 20 and the frame 10.

As a result of the locking effect between the plastics material of the frame and the metal plate, the plate cannot be displaced from its position on the inner surface of the moulded frame under conditions of applied stress or deformation of the moulding.

Having now described my invention, what I claim is:

1. A frame for a games racket, said frame consisting of a hollow moulding made from a plastics material and a rigid member, said rigid member being integrally moulded with said plastics material and completely embedded therein so as to reinforce said hollow moulding in a region corresponding to the crown portion of said frame, said rigid member having a plurality of perforations the individual diameter of some of said perforations being non-uniform along their length whereby, when said rigid member is moulded integrally with said hollow plastics moulding, the plastics material penetrates said perforations and sets therein to lock said rigid member to said hollow moulding, said rigid member being of generally U-shaped channel section and being so positioned relative to said hollow moulding that the base of the U lies adjacent the strung area of the frame.

2. The frame of claim 1, wherein said rigid member is made from a metal.

3. The frame of claim 2, wherein said rigid member is made of aluminium.

4. The frame of claim 1, wherein said rigid member is made from an alloy.

5. The frame of claim 4, wherein said rigid member is made from an alloy selected from the group consisting of mild steel, stainless steel and brass.

6. The frame of claim 1, wherein said hollow moulding is made from a fibre-reinforced plastics material.

7. The frame of claim 6, wherein said hollow moulding is made from a thermosetting-plastics material reinforced with fibres selected from the group consisting of carbon fibres, glass fibres and a combination of said carbon fibres with said glass fibres.

* * * * *